US005823277A

United States Patent [19]

Delwiche et al.

[11] Patent Number: 5,823,277

[45] Date of Patent: Oct. 20, 1998

[54] CUTTING EDGE FOR MONOBLOC DRILLING TOOLS

[75] Inventors: Robert Delwiche, Brussels, Belgium; Alain Besson, Chevreuses, France

[73] Assignees: Total, Puteaux, France; DB Stratabit S.A., Brussels, Belgium

[21] Appl. No.: 793,726

[22] PCT Filed: Jun. 7, 1996

[86] PCT No.: PCT/FR96/00861

§ 371 Date: May 1, 1997

§ 102(e) Date: May 1, 1997

[87] PCT Pub. No.: WO97/00372

PCT Pub. Date: Jan. 3, 1997

[30] Foreign Application Priority Data

Jun. 16, 1995 [FR] France ..... 95 07240

[51] Int. Cl.[6] ..... E21B 10/56

[52] U.S. Cl. ..... 175/428; 175/431

[58] Field of Search ..... 175/374, 428, 175/432, 420.2, 431; 299/110, 111

[56] References Cited

U.S. PATENT DOCUMENTS

| | | | |
|---|---|---|---|
| 4,109,737 | 8/1978 | Bovenkerk | 175/430 |
| 4,373,593 | 2/1983 | Phaal et al. | 175/430 |
| 4,932,484 | 6/1990 | Warren et al. | 175/431 |
| 5,120,327 | 6/1992 | Dennis | 51/293 |
| 5,172,778 | 12/1992 | Tibbitts et al. | 175/420.1 |
| 5,279,375 | 1/1994 | Tibbitts et al. | 175/428 |
| 5,486,137 | 1/1996 | Flood et al. | 175/428 X |
| 5,494,477 | 2/1996 | Flood et al. | 175/428 X |
| 5,520,444 | 5/1996 | Kosobrodov et al. | 299/111 X |

FOREIGN PATENT DOCUMENTS

| | | |
|---|---|---|
| 211642 | 2/1987 | European Pat. Off. . |
| 291314 | 11/1988 | European Pat. Off. . |
| 370717 | 5/1990 | European Pat. Off. . |
| 2138864 | 10/1984 | United Kingdom . |

*Primary Examiner*—David J. Bagnell

*Attorney, Agent, or Firm*—Sughrue, Mion, Zinn, Macpeak & Seas, PLLC

[57] ABSTRACT

An integral tool bit for drilling a rock formation, including a cemented metal carbide holder (30) attached to the tool and joined, e.g. soldered, to a plate (34) in the form of a cylindrical disc made from polycrystalline diamond particles and having a side wall (40), and a substantially flat free surface (36). The plate (34) is positioned so that the plane of its free flat surface (36) is at an acute angle (α) to a line (N) normal to the surface (25) of the rock formation, and the angle is directed in the same direction as the forward direction (F) of the drill bit so that the plate engages the rock formation with its side wall (40).

5 Claims, 1 Drawing Sheet

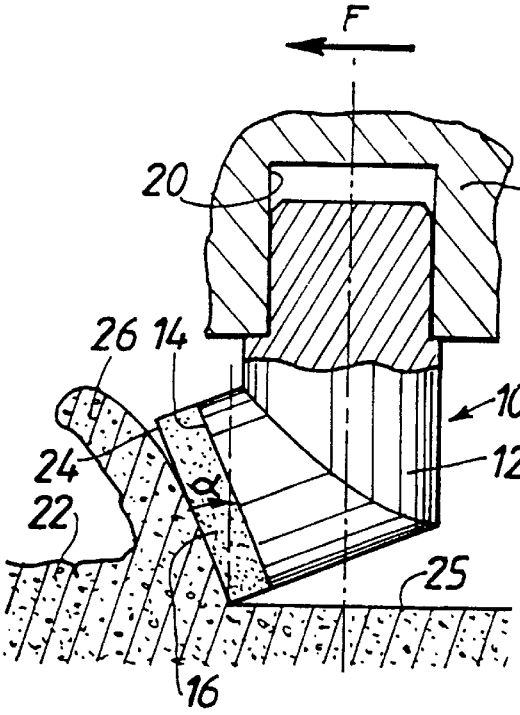
PRIOR ART FIG.1
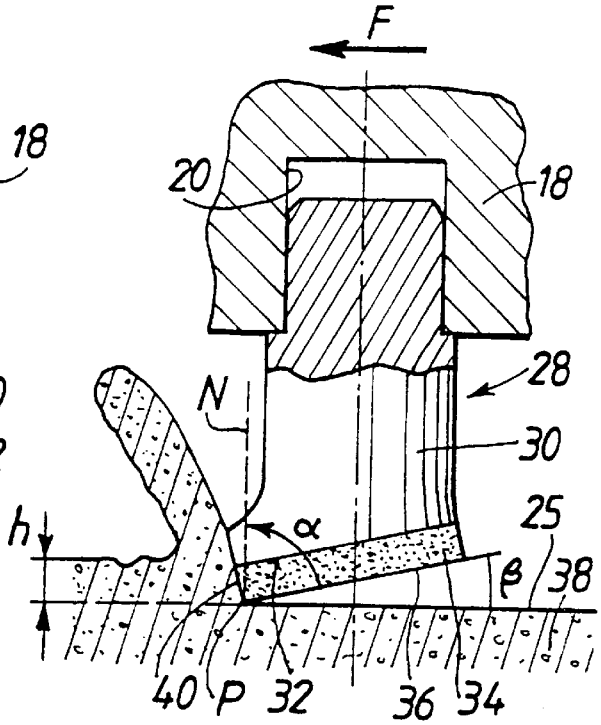
FIG.2
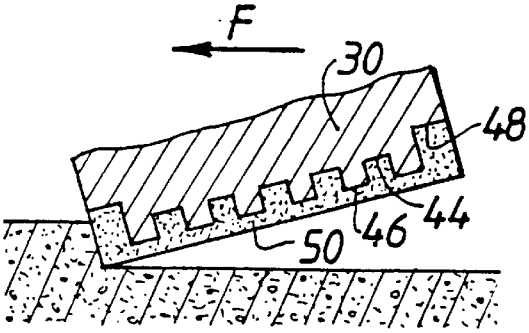
FIG.3
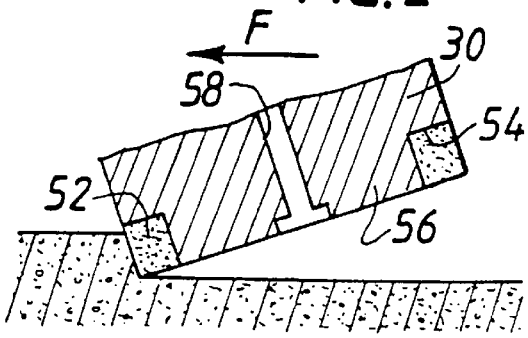
FIG.4
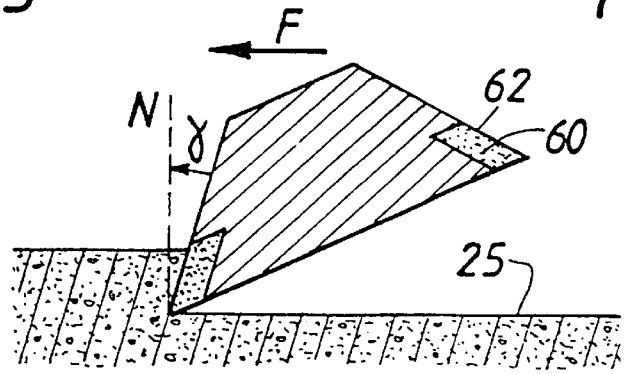
FIG.5

CUTTING EDGE FOR MONOBLOC DRILLING TOOLS

BACKGROUND OF THE INVENTION

The present invention concerns cutting elements, or edges, designed to be fastened to monobloc drilling tools used to drill in rock formations, for example in oil wells, or in drilling in cement.

A conventional cutting edge 10, such as the one illustrated in FIG. 1, attached, normally incorporates a base 12 in the form of a cylindrical block made of a case-hardened metal carbide, for example of tungsten carbide, and incorporating at one of its ends a flat inclined surface 14, to which a plate-shaped layer 16 formed from a mixture of fine polycrystal diamond (PDC), powdered cobalt, and tungsten carbide particles is attached, for example by soldering. This mixture is subjected to very high pressure and temperature, thus sintering it and making it integral with the base. The cutting edges thus manufactured are then fastened to the head of the drilling tool 18, for example by setting them in blind holes 20 pre-drilled on the head.

A cutting edge of this type is described, for example, in U.S. Pat. Nos. 4,073,354, 4,098,353, and 4,156,329. In the working position, the cutting edge 10 is positioned in relation to the rock formation 22 as illustrated in FIG. 1: the free flat face 24 of the plate 16 forms, in conjunction with the normal line N perpendicular to the surface 25 of the rock formation, an acute angle $\alpha$ extending in the direction opposite the direction of movement F of the cutting edge, in such a way that the plate 16 digs into the formation by means of its flat face 24.

This cutting edge works by compression of the diamond-charged face; that is, as illustrated in FIG. 1, the rock generates pressure on the flat diamond-charged face 24. A rock cutting 26 forms and breaks in front of this face. If the rock is fragile, the cutting is pulverized and broken apart, thereby leaving an accumulation of small fragments in front of the plate face. The impression left on the rock by the cutting edge will gave a shape complementary to that of the lower portion of the cutting edge. For example, when the cutting edge is cylindrical, the impression will be shaped like a sector of a cylinder. The cutting edge must, therefore, possess sufficient strength to cut into the rock frontally over the entire extent of this cylindrical sector-shaped area. It will be understood that cutting can be performed quite effectively in soft to medium-hard rock formations, but much less effectively in hard formations, because of the considerable force required to break up the rock simultaneously over the entirety of said area.

Furthermore, this force normally produces harmful vibratory phenomena during the life-span of the tool.

SUMMARY OF THE INVENTION

The present invention is intended to solve these problems and, to that end, it concerns a cutting edge of a monobloc tool used to drill a rock formation, of the type comprising a base made of a case-hardened metal carbide fastened to the tool and to which is attached, for example by soldering, a plate in the form of a cylindrical disk made up of polycrystal diamond particles and fitted with a lateral wall and a substantially flat free face, this cutting edge being characterized by the fact that the plate is positioned so that the plane of its flat face forms, in conjunction with the line perpendicular to the surface of the rock formation, an acute angle lying in the same direction as the direction of movement of the tool, with the result that the lateral wall of the plate cuts into the rock formation.

This position of the plate, which is substantially 90° to the position of the plate in the conventional cutting edge in FIG. 1, is completely unexpected, since it causes the flat face of the plate to work by shear action. This is a revolutionary advance running counter to the ideas customarily accepted in the field, which dictate that the plate must always undergo compression, as in the case illustrated in FIG. 1, for, should the plate be subjected to shear action, it could be prematurely destroyed. However, recent progress in the area of PDC plates (reduction of residual stresses, improved impact-resistance, enhanced temperature resistance and improved quality control) now make it possible to operate the plates in such a way that they are subjected to shear action, but without reducing their working life.

This positioning entails, moreover, major advantages:

- it allows the use of working angles that are more aggressive, and thus yielding higher performance levels, by inclining the plate "almost flat" on the surface of the formation;
- the plate functions no longer with its free face in contact with the cutting, but with its cylindrical lateral wall (along its entire thickness) in contact with the formation. The cutting formed during operation is, accordingly, no longer in contact with the flat face, but with the cylindrical wall of the plate. As a result, the plate breaks up the rock not only by shear action, but also by punching out the rock;
- forces are distributed radially over the cylindrical wall of the plate, thereby attenuating tool vibration;
- the thickness of the diamond-charged layer subjected to cutting stresses no longer measures several tenths of a millimeter, as is true of the plate in FIG. 1, but several millimeters. Thus, the life-span of the plate is increased appreciably.

BRIEF DESCRIPTION OF THE DRAWINGS

The invention will now be described with respect to the attached drawings, in which:

FIG. 1 is a cross-section of a cutting edge according to prior art, which is set in a monobloc drilling tool (shown only partially);

FIG. 2 is a cross-section of a cutting edge according to the invention;

FIG. 3 is a cross-section of a cutting edge according to a second embodiment of the invention;

FIG. 4 is a cross-section of a cutting edge according to a third embodiment of the invention; and FIG. 5 is a cross-section of a cutting edge according to a fourth embodiment of the invention.

DETAILED DESCRIPTION OF THE PREFERRED EMBODIMENTS

The cutting edge 28 according to the invention as illustrated in FIG. 2 comprises a cylindrical base 30 made of case-hardened tungsten carbide and set in a dead hole 20 drilled in the monobloc tool 18. It incorporates an inclined flat face 32 to which a plate 34 made of PDC and shaped like a cylindrical disk is fastened, by soldering or some other method.

According to a major feature of the invention, the free face 36 of the plate forms, in conjunction with the line N perpendicular to the surface 25 of the rock formation, an acute angle $\alpha$ lying in the same direction as the direction of movement F of the cutting edge.

As previously emphasized, this position is an abnormal position in the field of monobloc drilling tools, in which the angle α which the free face of the plate forms with the normal line N lies in the direction opposite the direction of movement of the tool.

In FIG. 2, the position of the plate lies at about 90° to the position shown in FIG. 1 and makes it possible to work at inclinations β of the face 36 positioned "virtually flat" in relation to the surface 25 of the formation 38. Accordingly, the rock may be cut at more aggressive angles than those possible using cutting edges according to prior art. Advantageously, the inclination β may vary between 0° and 25°.

As illustrated in FIG. 2, the plate operates in conjunction with its cylindrical lateral wall 40 over its entire thickness. In this way, it punches out the rock at its lowest point P at the same time that it generates shearing action.

In the cutting edge just described, the plate 34 has a uniform thickness and, as a cost-savings measure, the thickness thereof is relatively small, i.e., about 0.5 to 1 mm. The cutting thickness h will, therefore, also be small. The cutting edge according to this embodiment thus basically serves to work in medium-hard to hard ground.

In accordance with the invention, the use of the cutting edge shown in FIG. 3 allows cutting depths significantly greater using the same quantity of PDC, and thus at the same cost. A series of rectilinear parallel grooves running through the central portion of the surface are formed on the inclined surface of the base 30 of the cutting edge. These grooves delimit ribs 46 and they end in a peripheral groove 48 on the periphery of said surface. The groove 48 may be deeper than the central grooves 44. A thin diamond-charged layer 50 is made to adhere to the surface of the base, and it fills all of the grooves 44, 48 and extends slightly beyond the tops of the ribs.

In this way, the maximum amount of PDC is concentrated in the peripheral portion of the cutting edge. The peripheral groove may be given a depth much greater than the thickness of standard plates. The tools incorporating such cutting edges can drill a wider range of ground hardnesses. In addition, these cutting edges have a longer life-span than those illustrated in FIG. 1.

It is obvious that the ribs and rectilinear grooves may be replaced with any raised pattern incorporating projections and recesses.

In the variant illustrated in FIG. 4, there is no thin diamond-charged layer extending over the entire face of the cutting edge, but only a ring 52 made of PDC positioned in a peripheral groove 54 formed on the inclined surface of the base. The free face of the ring fits snugly against the central tungsten carbide core 56.

The ring 52 may also be thicker and higher than it is in the embodiment shown in FIG. 3. The tool equipped with these cutting edges can, therefore, drill formations ranging from the softest to the hardest.

Another advantage of this cutting edge lies in the fact that the tungsten carbide core 56 may be drilled with a hole 58 allowing insertion of a screw, by means of which the cutting edge can be fastened to the body of the tool.

In a variant shown in FIG. 5, the cutting edge is tapered and, as in the embodiment depicted in FIG. 4, incorporates a ring 60 made of PDC on the periphery of its long side. The lateral wall of the ring merges with the tapered wall of the cutting edge. When this cutting edge is positioned in accordance with the invention, that is, with its long side "nearly flat" in relation to the surface of the formation, the rock may be cut at a positive working angle γ. It will be recalled that the working angle is the angle formed by the tapered lateral wall 62 of the ring and by the line perpendicular to the surface of the rock formation. It is well known in conventional mechanics that this type of cutting edge can yield excellent results when the substances to be cut become plastic. Furthermore, this cutting edge gives a high speed of penetration of the tool. Here again, the cutting edge may be attached to the body of the monobloc tool with a screw.

We claim:

1. A cutting edge of a monobloc tool for drilling a rock formation comprising: a base (30) made of case-hardened metal carbide and fastened to the tool, and a plate (34) attached to the base, covering an entire lower surface thereof, and shaped as a cylindrical disk made from polycrystal diamond particles, the plate having a lateral wall (40), and a substantially flat free face (36), wherein the plate is disposed such that a plane of its flat free face forms, with a line N perpendicular to the surface (25) of the rock formation, an acute angle (α) lying in the same direction as the direction of movement (F) of the cutting edge, with the result that the plate cuts into the rock formation by its lateral wall.

2. A cutting edge according to claim 1, wherein an angle (β) which the plane of the flat free face (36) of the plate forms with the surface (25) of the rock formation is between 0° and 25°.

3. A cutting edge according to claim 1, wherein the plate (34) has constant thickness over the entire surface of the base to which it is fastened.

4. A cutting edge according to claim 1, wherein the plate is attached to an inclined face of the base, on which raised patterns defining recesses (44) and projections (46) are formed, said face also comprising, on a periphery thereof, a groove (48) having a depth greater than that of said recesses, the layer of polycrystal diamond constituting the plate filling said recesses and covering tops of the projections with a thin layer.

5. A cutting edge of a monobloc tool for drilling a rock formation comprising: a base (30) made of case-hardened metal carbide and fastened to the tool, and a single polycrystal diamond ring (52) attached to the base and having a lateral wall (40), wherein the base has a substantially flat free face, wherein the base is positioned such that the plane of its flat free face forms, with a line N perpendicular to the surface (25) of the rock formation, an acute angle (α) lying in the same direction as the direction of movement (F) of the cutting edge, with the result that the ring cuts into the rock formation by its lateral wall, wherein the ring is fastened in a peripheral groove (54) formed on the edge of the flat free face of the base, the remaining portion of said face of the base not being covered with polycrystal diamond, and wherein the base is drilled with a hole (58) in the area not covered with polycrystal diamond, in order to allow insertion of a screw intended to attach the cutting edge to the body of the monobloc tool.

* * * * *